US006383611B1

(12) United States Patent
Kohno et al.

(10) Patent No.: US 6,383,611 B1
(45) **Date of Patent: *May 7, 2002**

(54) INK JET RECORDING SHEET AND PROCESS FOR ITS PRODUCTION

(75) Inventors: Akira Kohno; Osamu Kojima, both of Tokyo (JP)

(73) Assignee: Mitsubishi Paper Mills Limited, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/047,400

(22) Filed: Mar. 25, 1998

(30) Foreign Application Priority Data

Mar. 26, 1997 (JP) ..... 9-074007
Mar. 6, 1998 (JP) ..... 10-054648

(51) Int. Cl.[7] ..... B41M 5/00
(52) U.S. Cl. ..... 428/195; 428/331; 427/146
(58) Field of Search ..... 428/195, 331

(56) References Cited

U.S. PATENT DOCUMENTS 4,915,923 A 4/1990 Ogawa et al.
5,013,603 A * 5/1991 Ogawa et al. ..... 428/331
5,609,964 A * 3/1997 Ogawa et al. ..... 428/520

OTHER PUBLICATIONS

Patent Abstracts of Japan, vol. 10, No. 336 (M–535), Nov. 14, 1986, JP 61–141584, Jun. 28, 1986.
Patent Abstracts of Japan, vol. 11, No. 76 (M–569), Mar. 7, 1987, JP 61–230979, Oct. 15, 1986.
Patent Abstracts of Japan, vol. 9, No. 107 (M–378), May 11, 1985, JP 59–230787, Dec. 25, 1984.

* cited by examiner

*Primary Examiner*—Pamela R. Schwartz
(74) *Attorney, Agent, or Firm*—Oblon, Spivak, McClelland, Maier & Neustadt, P.C.

(57) ABSTRACT

An ink jet recording sheet having an ink receiving layer formed on at least one side of a support, wherein the pore volume in the ink receiving layer is at least 0.80 ml/g, and the pore volume of pores with pore radii of from 5,000 to 50,000 Å in the ink receiving layer is at least 0.40 ml/g.

10 Claims, 1 Drawing Sheet

INK JET RECORDING SHEET AND PROCESS FOR ITS PRODUCTION

The present invention relates to an ink jet recording sheet and a process for its production. More particularly, it relates to an ink jet recording sheet whereby ink absorptivity is good, the diameter of dots is small, the shape of dots is substantially spherical, the image is clear and sharp, the water resistance is excellent and the coated layer strength is high with no substantial falling of powder, and a process for its production.

The ink jet recording system is a system wherein fine droplets of ink are jetted by various operational principles and deposited on a recording sheet such as a paper sheet to form a record of images or letters. By virtue of its excellent characteristics such as high speed, low noise, easiness to produce multi-color images, applicability to a wide variety of record patterns and unnecessity of development or fixation, it has found a wide range of applications in various recording apparatus for figures including Chinese characters and for color images.

Various efforts have been made with respect to the apparatus and ink to make it possible to use wood free paper or coated paper which is commonly used for printing or writing, as the recording sheet to be used for this ink jet recording system. However, along with the improvement in performance of the ink jet recording apparatus, such as high speed printing, full color printing and high sharpness like a photograph and with a progress in expansion of its applications, a high level of image quality has been demanded. Accordingly, it has now been required that the recording sheet has the following high levels of properties.

(1) It is excellent in sheet feeding at the time of recording by a common recording apparatus.
(2) Cockling or strike through of an image recorded on a front surface can be prevented, and printed images of high quality can be obtained within a wide range of temperature and humidity conditions.
(3) The printed dot density and the image density are high.
(4) The coloring properties and sharpness of the images are good.
(5) The shape of printed dots is good.
(6) The absorptivity of ink is good.
(7) The image storage properties such as the water resistance, light resistance and ozone resistance of printed images, are good.
(8) In the case of a coated type recording sheet, the adhesion of the coated layer is good with no substantial falling of powder.
(9) Yellowing of the recording sheet itself scarcely occurs.
(10) As compared with the dot diameter at a monochromatic portion, the dot diameter at a superposed colored portion is not substantially different, and highly fine printed images can be obtained with no substantial bleeding at the superposed colored portion.

An ink jet recording sheet having all of the above properties, is possible only with a coated type ink jet recording sheet i.e. a recording sheet to be used exclusively for ink jet recording, which contains a white inorganic pigment excellent in absorptivity, such as porous synthetic amorphous silica, as the main component in an ink receiving layer. The dot density is preferably 360 dots/inch, more preferably 720 dots/inch and further preferably higher than this, and the smaller the dot diameter, the better. Accordingly, one having a small particle size is used as the white inorganic pigment such as amorphous silica to be contained in the ink receiving layer. Such a highly fine ink jet recording sheet, the larger the dot diameter, the more the bleeding at a superposed colored portion, whereby the sharpness of the recorded images tends to be low. Further, with such a highly fine ink jet recording sheet, a high grade of the image quality is regarded as most important. If the absorptivity of amorphous silica changes, such a change influences substantially the image quality of the ink jet recording sheet. With a highly fine image having a substantial amount of inking, there has been a problem that if the absorptivity of amorphous silica decreases, bleeding at a superposed colored portion tends to be substantial, whereby the image quality is likely to be substantially low.

A highly fine ink jet recording sheet has had a drawback that the surface strength, the water resistance and the bond strength of the ink receiving layer tend to be low, since the ink receiving layer contains amorphous silica having a small particle size, and a water-soluble binder incorporated to the ink receiving layer as an adhesive is captured in pores of the amorphous silica. If the surface strength decreases, falling of powder tends to be substantial i.e. a powder falls from the ink receiving layer of an ink jet recording sheet, whereby the powder is likely to deposit on a cutter blade in the cutting operation or in the winding up operation, thus leading to a trouble in operation, or a paper powder is likely to accumulate on a feed roll of a printer, thus leading to failure in feeding, or in an application to letters or the like, when a printed sheet is folded and inserted into an envelope, a trouble such as falling of powder from the folded line, is likely to result. Otherwise, if the amount of the adhesive is increased to prevent such falling of powder, there has been a problem that the absorptivity tends to deteriorate, and the sharpness of the printed images tends to be low.

Further, if water resistance of an ink receiving layer deteriorates, there has been a problem that the coated layer is likely to peel by friction when the ink jet recording sheet is overlaid on another in a wet state immediately after printing. As described above, in the production of highly fine ink jet recording sheets, there have been many technical problems such as bleeding of a superposed colored portion of a printed image, falling of powder and deterioration in water resistance.

Various methods have been proposed to overcome such technical problems. For example, JP-A-9-263040 proposes to prevent falling of powder by increasing the coated layer strength by incorporating colloidal silica and sodium silicate in a certain specific ratio to the ink receiving layer. However, by the addition of an alkali such as sodium silicate, there has been a problem that the pore surface of amorphous silica tends to dissolve and precipitate during drying to clog pores, whereby the ink absorptivity tends to be low, and bleeding of printed images is likely to be facilitated. Further, there has been a practical problem that amorphous silica dissolves by the addition of an alkali, whereby the viscosity of the coating liquid abnormally increases so that preparation of the liquid becomes impossible.

As mentioned above, it has been known to incorporate an alkali to amorphous silica in order to increase the surface strength of the ink receiving layer of an ink jet recording sheet, but the prior art has disclosed nothing about stabilization of the pore surface of amorphous silica. Namely, in the prior art, no consideration has been made on such a point that amorphous silica undergoes a change in the pore surface state depending upon the number of days passed after the production or the temperature and humidity conditions of the environment during the storage, whereby the ink absorptivity changes to lead to bleeding of printed images or an increase of the viscosity of the coating liquid during the preparation of the coating liquid.

It is an object of the present invention to provide an ink jet recording sheet whereby highly fine printed images free from bleeding can be obtained, by analyzing the causes for the change in the image quality depending upon the number of days after the production of amorphous silica or the temperature and humidity conditions of the environment during the storage and stabilizing the pore surface thereby to stabilize the ink absorptivity.

Another object of the present invention is to provide an ink jet recording sheet which is free from bleeding of printed images or free from an increase of the viscosity of the coating liquid even when an alkali is added and which has improved water resistance and is free from falling of powder.

The present inventors have conducted various studies with respect to ink jet recording sheets and as a result, have found it possible to provide an ink jet recording sheet having stabilized absorptivity and free from bleeding of printed images by presenting an ink jet recording sheet having an ink receiving layer formed on at least one side of a support, wherein the pore volume in the ink receiving layer is at least 0.80 ml/g, and the pore volume of pores with pore radii of from 5,000 to 50,000 Å in the ink receiving layer is at least 0.40 ml/g. The ink receiving layer preferably contains amorphous silica as the main component and at least one of alkali metal hydroxides as an alkali. As the amorphous silica, particularly preferred is one having a secondary average particle size of from 2.0 to 8.0 $\mu$m, a BET specific surface area of from 250 to 400 $m^2/g$, an oil absorption of from 270 to 310 cc/100 g and a bulk specific gravity of from 100 to 250 g/l. Further, it has been found practically preferred that the amorphous silica is of a mixed system of water/amorphous silica or water/alkali/amorphous silica, and when it is formulated into a dispersed slurry having a concentration of from 16 to 20% with a pH of 6.0 to 11.6, the viscosity of the dispersed slurry is from 40 to 300 cps.

Further, the present inventors have found it possible to provide an ink jet recording sheet having stabilized absorptivity and free from bleeding of printed images by presenting an ink jet recording sheet having an ink receiving layer formed on at least one side of a support, wherein the ink receiving layer contains amorphous silica having a pore volume of from 0.80 to 2.00 ml/g in a solid state as dried after being formulated into a dispersed slurry at pH 11. As the amorphous silica, particularly preferred is one having a secondary average particle size of from 2.0 to 8.0 $\mu$m, a BET specific surface area of from 250 to 400 $m^2/g$, an oil absorption of from 270 to 310 cc/100 g and a bulk specific gravity of from 100 to 250 g/l. Further, it is practically preferred that the amorphous silica is of a mixed system of water/amorphous silica or water/alkali/amorphous silica, and when it is formulated into a dispersed slurry having a concentration of from 16 to 20% and a pH of from 6.0 to 11.6, the viscosity of the dispersed slurry is from 40 to 300 cps. The ink receiving layer preferably contains at least one of alkali metal hydroxides.

As a process for producing such an ink jet recording sheet, it is preferred to employ a process which comprises treating amorphous silica having a secondary average particle size of from 2.0 to 8.0 $\mu$m, a BET specific surface area of 250 to 400 $m^2/g$, an oil absorption of from 270 to 310 cc/100 g and a bulk specific gravity of from 100 to 250 g/l, by at least one method selected from ① a method of leaving it to stand still naturally for at least 10 days, ② a method of leaving it in an environment at a temperature of from 50 to 70° C. for at least 3 days, ③ a method of leaving it in an environment with a humidity of from 60 to 80% for at least 3 days, and ④ a method of leaving it in an environment at a temperature of from 50 to 70° C. and with a humidity of from 60 to 80% for at least 2 days, then formulating it into a dispersed slurry, and coating the slurry on a support to form an ink receiving layer.

BRIEF DESCRIPTION OF THE DRAWING

In the accompanying drawing.

Figure 1:
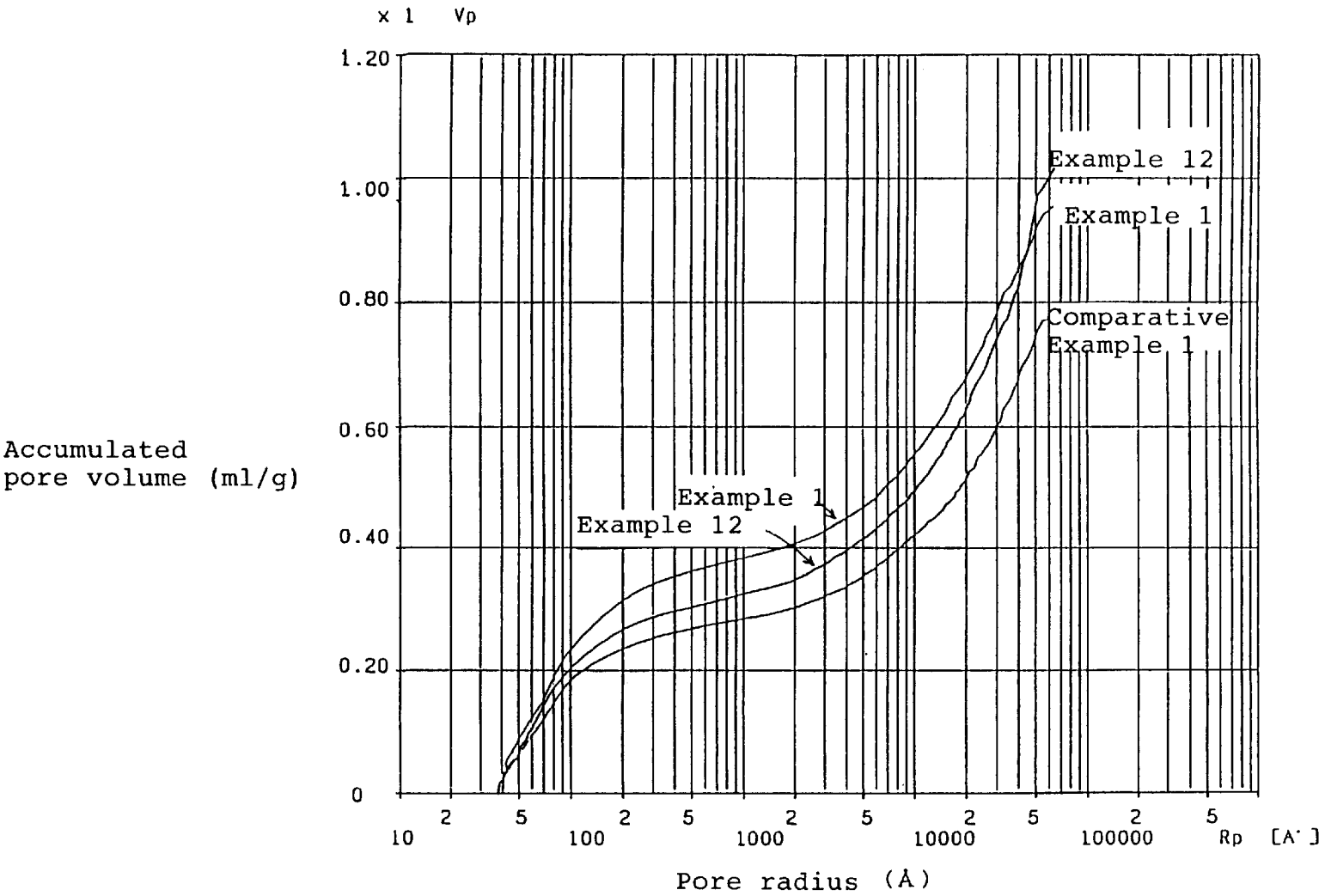
FIG. 1 is a graph showing an accumulated pore volume in an ink receiving layer.

In the present invention, the pore volume and the pore radii in the ink receiving layer are values obtained by peeling only the ink receiving layer from the ink jet recording sheet, and measuring the peeled ink receiving layer by a mercury porosimeter. In the present invention, the pore volume without specifying the range of pore radii, is meant for an accumulated pore volume of pores having pore radii of from 40 Å to 60,000 Å.

Of the ink jet recording sheet of the present invention, if the pore volume in the ink receiving layer is less than 0.80 ml/g, or if the pore volume of pores having pore radii of from 5,000 to 50,000 Å is less than 0.40 ml/g, the ink absorptivity tends to be poor, and flooding is likely to result at a superposed colored portion where the amount of ink is substantial.

The ink receiving layer of the present invention usually contains a known white pigment and may contain an alkali, an acidic colloidal silica, a water base polymer binder, a cationic dye fixing agent or other additives.

The white pigment may, for example, be a white inorganic pigment such as amorphous silica, calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, pseudo boehmite, aluminum hydroxide, alumina, lithopone, zeolite, hydrated halloysite, magnesium carbonate or magnesium hydroxide, or a white organic pigment such as styrene-type plastic pigment, polyethylene, microcapsules, a urea resin or a melamine resin. They may be used alone or in combination as a mixture of two or more of them. Among these white pigments, porous amorphous silica, or a porous white inorganic pigment such as magnesium carbonate or alumina, is preferred as the main component of the ink receiving layer. Particularly preferred is porous amorphous silica having a large pore volume.

As such porous amorphous silica having a large pore volume, silica made of various methods such as a wet system gelling method, a wet system precipitation method and a wet system semi gel method, may be used, but particularly preferred is silica prepared by a wet system precipitation method. For example, a group of commercial products including Mizukasil manufactured by Mizusawa Kagaku Kogyo K.K., Finesil manufactured by Kabushiki Kaisha Tokuyama, Carplex manufactured by Shionogi pharmaceutical Company Limited, and Nipsil manufactured by Nippon Silica Kogyo K.K., and partially modified ones thereof, may be mentioned. The pore volume of amorphous lo silica is a value obtained in such a manner that a dispersed slurry having a concentration of 19% and a pH of 11 is prepared by adding sodium hydroxide and amorphous silica in this order and then dried to a solid state (hereinafter this treatment of bringing the dispersed slurry to a solid state will be referred to simply as dispersed slurry treatment at pH 11), and the dried product is measured by a mercury porosimeter in the same manner as in the case of the ink receiving layer.

Of the ink jet recording sheet of the present invention, if the pore volume of amorphous silica contained in the ink receiving layer is less than 0.80 ml/g after the dispersed slurry treatment at pH 11, the pore surface of silica is likely to be eluted by the alkali, whereby the slurry is likely to be gelled, thus leading to dispersion failure or an increase of the viscosity of the slurry, even if the pore volume of the powder before treatment is at least 0.80 ml/g. Further, the dissolved silica is likely to precipitate in the pores, thus leading to clogging of pores and reduction of the pore volume, whereby the ink absorptivity tends to be inadequate when formed into an ink jet recording sheet, and flooding is likely to result at a superposed colored portion where the amount of ink is substantial, thus leading to a substantial deterioration in the image quality. On the other hand, if the pore volume of amorphous silica after the dispersed slurry treatment at pH 11, exceeds 2.0 ml/g, the capacity for absorbing ink will be large, such being preferred for an ink jet recording sheet, but it absorbs also dispersing water well during the preparation of the coating liquid, whereby in the same liquid concentration, free water contributing to dispersion tends to be less, thus leading to an increase of the viscosity, and consequently, the liquid concentration will have to be reduced. As a result, the amount of wet coating increases, whereby the setting after coating tends to be slow, and coating irregularities are likely to result, such being undesirable. Accordingly, the pore volume of amorphous silica after the dispersed slurry treatment at pH 11 is preferably within a range of from 0.80 to 2.00 ml/g, more preferably from 1.00 to 1.20 ml/g. By using such amorphous silica, the ink absorptivity of the ink jet recording sheet, and the viscosity of the dispersed slurry, can be optimized.

Further, the amorphous silica to be used in the present invention is preferably one having a secondary average particle size of from 2.0 to 8.0 $\mu$m, a BET specific surface area of from 250 to 400 $m^2/g$, an oil absorption of from 270 to 310 cc/100 g, a bulk specific gravity of from 100 to 250 g/l and a sharp particle size distribution.

The Post-treatment method will be described whereby amorphous silica immediately after the production is converted to amorphous silica having a pore volume of from 0.80 to 2.00 ml/g by the dispersed slurry treatment at pH 11 of the present invention. After the production, the silica material is pulverized and classified to obtain amorphous silica having a secondary average particle size of from 2.0 to 8.0 $\mu$m, a BET specific surface area of from 250 to 400 $m^2/g$, an oil absorption of from 270 to 310 cc/100 g and a bulk specific gravity of from 100 to 250 g/l, which is then subjected to post treatment of e.g. ① leaving it to stand still naturally for at least 10 days, ② heating it in an environment at a temperature of at least 50° C. for at least 3 days, ③ humidifying it in an environment with a humidity of at least 60% for at least 3 days, or ④ heating and humidifying in an environment at a temperature of at least 50° C. with a humidity of at least 60% for at least 2 days. Here, "leaving it to stand still naturally" means to leave it under usual room temperature and no-humidifying conditions. Among such Post-treatments, the heating and humidifying are treatment wherein heating and humidifying carried out simultaneously, is preferred, since the pore volume can thereby be increased most quickly.

The reason for the increase in the pore volume by leaving amorphous silica to stand still naturally or by the heating and humidifying treatment, may be considered as follows. It is believed that on the surface of the silica, silanol groups (—Si—OH) are located at the inner most side, bound water is present outside thereof, and adsorbed water is located further outside thereof. Amorphous silica immediately after the production by drying and classification, has a fracture surface on its surface so that the core of silica (—O—Si—O—) is exposed, and it is conceivable that silanol groups are not formed, and bound water or adsorbed water are not located on its surface. Accordingly, if an alkali is added to the dispersed slurry of such amorphous silica immediately after the production, the silica surface is readily eluted, and the eluted silica precipitates in pores during drying, thus leading to clogging of pores. Stabilization of the silica surface by the three layer structure of silanol groups, bound water and adsorbed water, is believed to be realized by supplying water to the fracture surface immediately after the production of the amorphous silica by leaving it to stand still naturally or by the heating and humidifying treatment.

In the present invention, ink receiving layer is capable of providing an ink jet recording sheet having an excellent image quality free from bleeding of printed images, even if no alkali is contained in the ink receiving layer. However, to prevent falling of powder and improve water resistance, it is preferred to add an alkali metal hydroxide as an alkali. By adding an alkali metal hydroxide such as sodium hydroxide or potassium hydroxide to the amorphous silica, amorphous silica particles tend to be bonded to one another via a hydrogen bond between the alkali hydrate ions and silanol groups on the amorphous silica surface, whereby the surface strength of the coated layer is improved, falling of powder from the coated layer of the ink jet recording sheet will be less, and the water resistance of the coated layer will be improved.

The reason for defining the dispersed slurry of amorphous silica used for the present invention to have a viscosity of from 40 to 300 cps at a concentration of from 16 to 20% at a pH of from 6.0 to 11.6, will be explained. Namely, pH 6.0 is the pH of the dispersed slurry of amorphous silica when no alkali is incorporated, and it is the lower limit value. If the pH exceeds 11.6, the amorphous silica is likely to be dissolved by the alkali and will precipitate during drying, whereby the pore volume tends to be small, and the viscosity of the dispersed slurry tends to be very high, thus leading to gelation or dispersion failure, such being undesirable. Further, if the viscosity of the dispersed slurry is less than 40 cps, coating irregularities are likely to result, and if it exceeds 300 cps, the slurry tends to undergo gelation or tends to be hardly dispersed, such being undesirable. By the addition of an alkali, the viscosity of the dispersed slurry of amorphous silica usually increases. Accordingly, it is necessary to control the slurry concentration to adjust the viscosity within a range of from 40 to 300 cps. If the concentration exceeds 20%, gelation or dispersion failure tends to result, such being undesirable. On the other hand, if the concentration is less than 16%, the viscosity will be less than 40 cps, whereby coating irregularities are likely to result, such being undesirable.

The water base polymer binder for bonding the white pigment in the ink receiving layer of the present invention may, for example, be a starch derivative such as oxidized starch, esterified starch or phosphoric acid esterified starch; a cellulose derivative such as carboxy methyl cellulose or hydroxyethyl cellulose; casein, gelatin, soybean protein, polyvinyl alcohol or a polyvinyl alcohol derivative such as a silyl-modified polyvinyl alcohol; polyvinyl pyrrolidone, a maleic anhydride resin, a stylene-butadiene copolymer, a conjugated diene type copolymer latex such as a methyl methacrylate-butadiene copolymer; an acrylic (co)polymer latex such as a polymer or copolymer of an acrylate or methacrylate; a vinyl type copolymer latex such as an ethylene/vinyl acetate copolymer; or functional group-modified (co)polymer latexes of these various (co)polymers, which are modified by monomers containing functional groups such as carboxy groups; a water base adhesive of e.g. a thermosetting synthetic resin such as melamine resin or a urea resin; a polymer or copolymer resin of an acrylate or methacrylate such as polymethyl methacrylate; a polyurethane resin, an unsaturated polyester resin, a vinyl chloride-vinyl acetate copolymer, a polyvinyl butyral or an aklyd resin. They may be used alone or in combination as a mixture of two or more of them. Among these water base polymer binders, polyvinyl alcohol or a polyvinyl alcohol derivative such as a silanol-modified polyvinyl alcohol, is preferred from the viewpoint of the adhesive strength. Such a water-base polymer binder is used preferably in an amount of from 10 to 100 parts by weight per 100 parts by weight of the white pigment.

The cationic dye fixing agent is a monomer, oligomer or polymer, preferably an oligomer or polymer, of a primary to tertiary amine or a quaternary ammonium salt, which exhibits a cationic nature upon dissociation when dissolved in water. Particularly preferred is a cationic dye fixing agent whereby the cation charge by a colloid titration method is from 1 to 10 meq/g. If the cation charge is less than 1 meq/g, the fixing performance of the water-soluble dye in the water-base ink tends to be poor, and the water resistance of printed images tends to be low. On the other hand, if it exceeds 10 meq/g, the water resistance of printed images can be improved even with a small amount, but the printed images tend to be poor in light resistance or ozone resistance, and the recording sheet tends to undergo yellowing. Accordingly, the cationic dye fixing agent is preferably contained in an amount of from 0.1 to 5 g/m$^2$ in the ink jet recording sheet to provide a cation charge of from 0.1 to 50 meq/m$^2$.

In the present invention, the ink jet recording sheet may contain acidic colloidal silica in the ink receiving layer. The acidic colloidal silica is preferably contained in an amount of from 10 to 50 parts by weight, more preferably from 20 to 50 parts by weight, per 100 parts by weight of the white pigment.

The support to be used in the present invention may, for example, be paper composed mainly of wood pulp, a film or synthetic paper made of e.g. a polyester film or polyolefin, or a resin-coated paper having a polyolefin resin coated on paper. The wood pulp may, for example, be a chemical pulp such as LBKP or NBKP, a mechanical pulp such as GP, PGW, RPM, TMP, CTMP, CMP or CGP, or a waste paper pulp such as DIP, and if necessary, conventional pigments or binders, and various additives such as a sizing agent, a fixing agent, a yield-improving agent, a cation-imparting agent and a reinforcing agent, may be incorporated. Further, an incorporated sizing agent may be added or not added, sizing agents such as a neutral sizing agent, a polymer sizing agent and an acidic sizing agent, may be used alone or in combination. The filler may or may not be contained. Further, the size press may or may not be applied. As an incorporated filler for a paper support, conventional pigments may be used alone or in combination as the white pigment.

The ink jet recording sheet of the present invention may be prepared, for example, in such a manner that pulp fibers are deflocculated to form a slurry, then a filler, a sizing agent and other additives may be added as the case requires, and this slurry is subjected to a paper making machine, followed by drying to form a sheet, which is subjected to machine calendering to obtain a support. Or, a water soluble material such as starch or a polymer material is size-pressed to a sheet dried after sheeting, as the case requires, followed by drying again, and the sheet is subjected to machine calendering to obtain a support. Then, on this support, a coating liquid for an ink receiving layer containing a white pigment, an alkali, a water base polymer binder, a cationic dye fixing agent and other additives, is coated by any coating apparatus or a size press apparatus such as an on-machine coater or an off-machine coater. After coating, calender finish is further carried out.

In the present invention, the coated amount of the ink receiving layer is not particularly limited, but is preferably within a range of from 5 to 15 g/m$^2$ as the dried coated amount. If the coated amount of the ink receiving layer is less than 5 g/m$^2$, the image density, the coloring property and the sharpness tend to be low, and feathering is likely to occur. If the coated amount exceeds 15 g/m$^2$, the drying load after coating increases, whereby not only the productivity decreases due to a decrease in the coating speed, but also the binder in the ink-receiving layer tends to migrate to the surface of the ink receiving layer together with an evaporating solvent during drying under a high load, whereby the porosity of the surface decreases, the ink absorptivity during printing tends to be impaired, and a background stain is likely to result, such being undesirable. However, the coated amount is not particularly limited in the present invention, and coating may be repeated twice or three times. Further, coating may be applied to both sides.

In the support and in the ink receiving layer in the ink jet recording sheet of the present invention, other additives such as a pigment, a dispersant, a thickener, a fluidity-improving agent, a defoaming agent, a foam-supressing agent, a release agent, a blowing agent, a penetrating agent, an ash-preventing agent, a water proofing agent, a wet-strength agent, a dry strength agent and a dye, may be suitably incorporated, as the case requires.

In the present invention, the ink is a recording liquid comprising a coloring agent, a solvent and other additives. The coloring agent may, for example, be a water-soluble dye or coloring pigment such as a direct dye, an acid dye, a basic dye, a reactive dye or a food coloring agent. Other additives may, for example, be a pH controlling agent, a metal sealing agent, a mildew proof agent, a viscosity-adjusting agent, a surface tension-adjusting agent, a wetting agent, a surfactant and a rust-preventing agent. Further, on the ink jet recording sheet of the present invention, recording may be made with an oil based ink i.e. a dye ink or pigment ink containing a so-called hydrophobic organic solvent.

Now, the present invention will be described-in further detail with reference to Examples. However, it should be understood that the present invention is by no means restricted to such specific Examples. In the Examples, "parts" and "%" mean "parts by weight" and "% by weight", unless otherwise specified.

Preparation of a Support 0.6 part of cationic starch, 10 parts of calcium carbonate heavy, 15 parts of precipitated calcium carbonate light and 0.1 part of an alkyl ketene dimer, were added to a pulp slurry comprising 67 parts of LBKP having a freeness of 450 ml CSF and 8 parts of NBKP having a freeness of 450 ml CSF, to adjust pH of the pulp slurry to 8.2, and the mixture was sheeted by a Fourdrinier paper machine and then dried. Then, an oxidized starch aqueous solution was impregnated thereto and dried by size press so that the solid content would be 5 g/m$^2$ on both sides, followed further by machine calender finishing to obtain a support for an ink jet recording sheet, having a weight of 75 g/m$^2$. The Stoeckigt sizing degree of the obtained support was 20 seconds.

Preparation of Amorphous Silica

Preparation of amorphous silica was carried out by a wet system precipitation method. Sodium silicate, sulfuric acid and water were mixed and reacted at a temperature of not higher than 100° C., followed by filtration, washing with water, drying, pulverization and classification to obtain amorphous silica having a secondary average particle size of 4.0 μm, a BET specific surface area of 290 $m^2/g$, an oil absorption of 270 cc/100 g and a bulk specific gravity of 150 g/l.

Post-treatments of Amorphous Silica

POST-TREATMENT EXAMPLES 1 TO 17

Post-treatments of the amorphous silica prepared as described above, were carried out under four different environments by changing the shelf time in a total of 17 Examples. The environments for the Post-treatments were the following four types;

① leaving the amorphous silica immediately after the preparation, in a room temperature and no humidifying environment (hereinafter referred to as natural environment treatment), ② leaving it in an environment at a temperature of from 50 to 70° C. and with a humidity of from 20 to 30% (hereinafter referred to as heating treatment), ③ leaving it in an environment at a temperature of from 20 to 40° C. and with a humidity of from 60 to 80% (hereinafter referred to as humidifying treatment), ④ leaving it in an environment at a temperature of from 50 to 70° C. and with a humidity of from 60 to 80% (hereinafter referred to as heating and humidifying treatment). Table 1 indicates the number of days for the post-treatment in Post-treatment Examples 1 to 17.

Dispersed Slurry at pH 11 of Amorphous Silica after Post-treatment

With respect to the amorphous silica after the Post-treatment in each of Post-treatment Examples 1 to 17, a dispersed slurry of pH 11 was prepared and dried to a solid state, whereupon the pore volume was measured, as follows. Firstly, 12 parts of an aqueous sodium hydroxide solution having a concentration of 25% (solid content: 3 parts) was added to 423 parts of water to obtain an alkaline aqueous solution of pH 13. Then, 107.5 parts (solid content: 100 parts) of the amorphous silica (solid content: 93%) was added thereto, followed by stirring to obtain a slurry having a total solid content concentration of 19.0% and a pH of 11.0. Then, this dispersed slurry was dried to a solid state, and the solid was subjected to a mercury porosimeter (manufactured by Shimadzu Corporation) to measure the pore volume and the pore radii. With respect to the amorphous silica of each of Post-treatment Examples 1 to 17, the pore volume after treatment of the dispersed slurry of pH 11 is shown in Table 1.

EXAMPLE 1

12 parts of an aqueous sodium hydroxide solution having a concentration of 25% (solid content: 3 parts) was added to 423 parts of water and dissolved to obtain a solution of pH 13. Then, 107.5 parts (solid content: 100 parts) of the amorphous silica (solid content; 93%) of Post-treatment Example 1 was added and dispersed -to obtain a dispersed slurry having a total solid content concentration of 19.0%, a pH of 11.0 and a viscosity of 100 cps (B-type viscometer). To this dispersed slurry, 30 parts of polyvinyl alcohol (PVA 117, manufactured by Kuraray Co., Ltd.) and 30 parts of a cationic dye fixing agent (Sumirez Resin 1001, manufactured by Sumitomo Chemical Co., Ltd.) were added to obtain a coating liquid for an ink receiving layer. On the support prepared as described above, this coating liquid for an ink receiving layer was coated by means of an air knife coater so that the solid content would be 10 $g/m^2$, and dried, followed by humidifying treatment and further by super calender finishing to obtain an ink jet recording sheet of Example 1.

EXAMPLES 2 TO 13 AND COMPARATIVE EXAMPLES 1 TO 4

Ink jet recording sheets of Examples 2 to 13 and Comparative Examples 1 to 4 were, respectively, prepared in the same manner as in Example 1 with respect to all conditions including preparation and coating of coating liquids and super calender finishing, except that the amorphous silica of Post-treatment Example 1 used in Example 1 was changed to the amorphous silica of Post-treatment Examples 2 to 17, respectively. The viscosities of the respective dispersed slurries are shown in Table 2.

EXAMPLE 14

An ink jet recording sheet of Example 14 was-prepared in the same manner as in Example 1 except that water was changed to 419 parts and the aqueous sodium hydroxide solution having a concentration of 25% was changed to 16 parts (solid content: 4 parts). The total solid content concentration of the dispersed slurry of the amorphous silica was 19.0%, the pH was 11.6, and the viscosity was 80 cps.

EXAMPLE 15

An ink jet recording sheet of Example 15 was prepared in the same manner as in Example 1 except that water was changed to 417 parts, and the aqueous sodium hydroxide solution having a concentration of 25% was changed to 18 parts (solid content: 4.5 parts). The total solid content concentration of the dispersed slurry of the amorphous silica was 19.0%, the pH was 11.8, and the viscosity was 80 cps.

EXAMPLE 16

15.8 parts of an aqueous sodium silicate solution (Sodium Silicate No. 3, manufactured by Asahi Denka) having a concentration of 38% (solid content: 6 parts) was added to 539 parts of water to obtain a solution of pH 12.6. Then, 107.5 parts (solid content: 100 parts) of the amorphous silica of Post-treatment Example 1 (solid content: 93%) was added and dispersed thereto to obtain a dispersed slurry having a total solid content concentration of 16.0%, a pH of 10.2 and a viscosity of 40 cps. To this dispersed slurry, 30 parts of polyvinyl alcohol (PVA 117, manufactured by Kuraray Co., Ltd.) and 20 parts of a cationic dye fixing agent (Polyfix 604, manufactured by Showa Kobunshi K.K., cation charge: 10 meq/g) were added to obtain a coating liquid for an ink receiving layer. On the same support as used in Example 1, this coating liquid for an ink receiving layer was coated by means of an air knife coater so that the solid content would be 10 $g/m^2$, and dried, followed by humidifying treatment and further by super calender finishing to obtain an ink jet recording sheet of Example 16.

EXAMPLE 17

10.5 parts (solid content: 4 parts) of an aqueous sodium silicate solution (Sodium Silicate No. 3, manufactured by Asahi Denka) having a concentration of 38%, was added to 532 parts of water and dissolved to obtain a solution of pH 11.5. Then, 107.5 parts (solid content: 100 parts) of the amorphous silica of Post-treatment Example 1 (solid content 93%) was added and dispersed to obtain a dispersed slurry having a total solid content concentration of 16.0%, a pH of 9.7 and a viscosity of 160 cps. The subsequent steps were the same as in Example 1 to obtain an ink jet recording sheet of Example 17.

EXAMPLE 18

5.3 parts (solid content: 2 parts) of an aqueous sodium silicate solution (Sodium Silicate No.3, manufactured by Asahi Denka) having a concentration of 38%, was added to 525 parts of water and dissolved to obtain a solution of pH 11.0. Then, 107.5 parts (solid content: 100 parts) of the amorphous silica of Post-treatment Example 1 (solid content: 93%) was added and dispersed to obtain a dispersed slurry having a total solid content concentration of 16.0%, a pH of 9.0 and a viscosity of 160 cps. The subsequent steps were the same as in Example 1, whereby an ink jet recording sheet of Example 18 was obtained.

COMPARATIVE EXAMPLE 6

An ink jet recording sheet of Comparative Example 6 was prepared in the same manner as in Example 16 except that the amorphous silica of Post-treatment Example 1 in Example 16 was replaced by the amorphous silica of Post-treatment Example 14. The dispersed slurry of the amorphous silica had a total solid content concentration of 16.0%, a pH of 10.2 and a viscosity of 320 cps.

COMPARATIVE EXAMPLE 7

An ink jet recording sheet of Comparative Example 7 was prepared in the same manner as in Example 17 except that the amorphous silica of Post-treatment Example 1 in Example 17 was replaced by the amorphous silica of Post-treatment Example 14. The dispersed slurry of the amorphous silica had a total solid content concentration of 16.0%, a pH of 9.7 and a viscosity of 320 cps.

COMPARATIVE EXAMPLE 8

An ink jet recording sheet of Comparative Example 8 was prepared in the same manner as in Example 18 except that the amorphous silica of Post-treatment Example 1 in Example 18 was replaced by the amorphous silica of Post-treatment Example 14. The dispersed slurry of the amorphous silica had a total solid content concentration of 16.0%, a pH of 9.0 and a viscosity of 320 cps.

EXAMPLE 19

107.5 parts (solid content: 100 parts) of the amorphous silica of Post-treatment Example 1 (solid content: 93%) was added to 480 parts of water to obtain a dispersed slurry having a total solid content concentration of 17.0, a pH of 6.6 and a viscosity of 200 cps. The subsequent steps were the same as in Example 1, whereby an ink jet recording sheet of Example 19 was prepared.

COMPARATIVE EXAMPLE 9

An ink jet recording sheet of Comparative Example 9 was prepared in the same manner as in Example 19 except that the amorphous silica of Post-treatment Example 1 in Example 19 was replaced by the amorphous silica of Post-treatment Example 14. The dispersed slurry of the amorphous silica had a total solid content concentration of 17.0%, a pH of 6.6 and a viscosity of 350 cps.

The amorphous silica and alkali used in each of Examples 1 to 19 and Comparative Examples 1 to 9, and the concentration, pH and viscosity of the dispersed slurry of the amorphous silica when the coating liquid for an ink receiving layer, was prepared, are shown in Table 2 or 3.

The ink receiving layers of the ink jet recording sheets prepared in Examples 1 and 12 and Comparative Example 1 were peeled, and they were subjected to a mercury porosimeter (manufactured by Simadzu Corporation) to measure the respective pore volumes. A graph of the accumulated pore volume is shown in FIG. 1.

With respect to all ink jet recording sheets prepared as described above, tests were carried out on the following evaluation items as an ink jet recording sheet, and the results are shown in Tables 4 and 5.

Evaluation Items (1) Printing Density

Printing was carried out on each ink jet recording sheet by means of BJC610J ink jet printer (manufactured by Canon Company), and the printing density of a black solid printing portion was measured by a Macbeth RD-918 model densitometer. There is no practical problem, if the printing density is at least 1.50. The printing density is preferably at least 1.70.

(2) Absorptivity

Using BJC610J ink jet printer, a black letter was printed on a yellow solid printing portion, whereby the feathering degree of the letter was visually evaluated.

A: No substantial feathering was observed, and the letter was sharp.

B: Slight feathering was observed, but no bleeding out of the letter was observed.

C.: Partial bleeding out of the letter was observed.

There is no practical problem, if the absorptivity is at a level of A or B.

(3) Falling of Powder

A black cloth was placed on the ink receiving layer of an ink jet recording sheet, and a load of 20 g/cm$^2$ was exerted thereon, whereupon the black cloth was pulled for 60 cm at a constant speed, and the amount of powder deposited on the black cloth was visually evaluated.

Evaluation standards

A: No substantial deposition of powder was observed.

B: Deposition of powder was observed at a part of the portion on which the weight was placed.

C: Deposition of powder was observed over the entire portion on which the weight was placed.

There is no practical problem, if the falling of powder is at a level of A or B.

(4) Water resistance

One droplet of water was dropped on the ink receiving layer of an ink jet recording sheet and rubbed five times repeatedly while exerting a pressure with a finger, whereby the water resistance was evaluated by the peeling degree of the ink receiving layer.

Evaluation Standards

A: No peeling was observed.

B: Slight peeling was observed.

C: Peeling was distinctly observed.

There is no practical problem, if the water resistance is at a level of A or B.

(5) Coating irregularities

Using an ink jet printer (BJC-820J, manufactured by Canon Company), coating irregularities were judged by irregularities of a solid printing portion of magenta ink. There is no practical problem, if the coating irregularities are at a level of the following A or B.

A: No printing irregularities was observed.

B: Slight printing irregularities were observed, but they were not distinct.

C: Due to printing irregularities, the difference in the printing density is distinct.

TABLE 1

| Post-treatment | Number of days for post-treatment after preparation (days): Natural environment treatment | Heating treatment | Humidifying treatment | Heating and humidifying treatment | Total number of days for treatment | Pore Volume (ml/g) |
|---|---|---|---|---|---|---|
| Example 1 | 40 | — | — | — | 40 | 1.00 |
| 2 | 25 | 15 | — | — | 40 | 1.20 |
| 3 | 25 | — | 15 | — | 40 | 1.20 |
| 4 | 25 | — | — | 15 | 40 | 1.30 |
| 5 | — | 15 | — | — | 15 | 1.00 |
| 6 | 10 | — | — | — | 10 | 0.80 |
| 7 | — | 3 | — | — | 3 | 0.80 |
| 8 | — | — | 3 | — | 3 | 0.80 |
| 9 | — | — | — | 2 | 2 | 0.81 |
| 10 | 365 | — | — | — | 365 | 1.20 |
| 11 | 60 | 7 | 3 | — | 70 | 1.40 |
| 12 | 60 | 20 | 10 | — | 90 | 2.00 |
| 13 | 60 | 20 | 12 | — | 92 | 2.20 |
| 14 | 5 | — | — | — | 5 | 0.70 |
| 15 | — | 2 | — | — | 2 | 0.75 |
| 16 | — | — | 2 | — | 2 | 0.76 |
| 17 | — | — | — | 1 | 1 | 0.77 |

TABLE 2

| | Amorphous siica | Alkali | Amount of alkali (per 100 parts of silica) | Despersed slurry: Concentration (%) | pH | Viscosity (cps) |
|---|---|---|---|---|---|---|
| Example 1 | Post-treatment Example 1 | Sodium hydroxide | 3 parts | 19.0 | 11.0 | 100 |
| Example 2 | Post-treatment Example 2 | Sodium hydroxide | 3 parts | 19.0 | 11.0 | 70 |
| Example 3 | Post-treatment Example 3 | Sodium hydroxide | 3 parts | 19.0 | 11.0 | 70 |
| Example 4 | Post-treatment Example 4 | Sodium hydroxide | 3 parts | 19.0 | 11.0 | 60 |
| Example 5 | Post-treatment Example 5 | Sodium hydroxide | 3 parts | 19.0 | 11.0 | 100 |
| Example 6 | Post-treatment Example 6 | Sodium hydroxide | 3 parts | 19.0 | 11.0 | 250 |
| Example 7 | Post-treatment Example 7 | Sodium hydroxide | 3 parts | 19.0 | 11.0 | 260 |
| Example 8 | Post-treatment Example 8 | Sodium hydroxide | 3 parts | 19.0 | 11.0 | 250 |
| Example 9 | Post-treatment Example 9 | Sodium hydroxide | 3 parts | 19.0 | 11.0 | 260 |
| Example 10 | Post-treatment Example 10 | Sodium hydroxide | 3 parts | 19.0 | 11.0 | 80 |
| Example 11 | Post-treatment Example 11 | Sodium hydroxide | 3 parts | 19.0 | 11.0 | 50 |
| Example 12 | Post-treatment Example 12 | Sodium hydroxide | 3 parts | 19.0 | 11 0 | 40 |
| Example 13 | Post-treatment Example 13 | Sodium hydroxide | 3 parts | 19.0 | 11.0 | 30 |
| Comparative Example 1 | Post-treatment Example 14 | Sodium hydroxide | 3 parts | 19.0 | 11.0 | 350 |
| Comparative Example 2 | Post-treatment Example 15 | Sodium hydroxide | 3 parts | 19.0 | 11.0 | 340 |
| Comparative Example 3 | Post-treatment Example 16 | Sodium hydroxide | 3 parts | 19.0 | 11.0 | 340 |
| Comparative Example 4 | Post-treatment Example 17 | Sodium hydroxide | 3 parts | 19.0 | 11.0 | 330 |

TABLE 3

| | Amorphous siica | Alkali | Amount of alkali (per 100 parts of silica) | Despersed slurry: Concentration (%) | pH | Viscosity (cps) |
|---|---|---|---|---|---|---|
| Example 14 | Post-treatment Example 1 | Sodium silicate | 4 parts | 19.0 | 11.6 | 80 |
| Example 15 | Post-treatment Example 1 | Sodium silicate | 4.5 parts | 19.0 | 11.8 | 80 |
| Example 16 | Post-treatment Example 1 | Sodium silicate | 6 parts | 16.0 | 10.2 | 40 |
| Example 17 | Post-treatment Example 1 | Sodium silicate | 4 parts | 16.0 | 9.7 | 160 |
| Example 18 | Post-treatment Example 1 | Sodium silicate | 2 parts | 16.0 | 9.0 | 160 |
| Comparative Example 6 | Post-treatment Example 14 | Sodium silicate | 6 parts | 16.0 | 10.2 | 320 |
| Comparative Example 7 | Post-treatment Example 14 | Sodium silicate | 4 parts | 16.0 | 9.07 | 320 |
| Comparative Example 8 | Post-treatment Example 14 | Sodium silicate | 2 parts | 16.0 | 9.0 | 320 |
| Example 19 | Post-treatment Example 1 | — | — | 17.0 | 6.6 | 200 |
| Comparative Example 9 | Post-treatment Example 14 | — | — | 17.0 | 6.6 | 350 |

TABLE 4

| | Properties of ink jet recording sheets: Printing density | Absorptivity | Falling of powder | Water resistance | Coating irregularities |
|---|---|---|---|---|---|
| Example 1 | 1.68 | A | A | A | A |
| Example 2 | 1.72 | A | A | A | A |
| Example 3 | 1.72 | A | A | A | A |
| Example 4 | 1.75 | A | A | A | A |
| Example 5 | 1.68 | A | A | A | A |
| Example 6 | 1.55 | B | A | A | A |
| Example 7 | 1.53 | B | A | A | A |
| Example 8 | 1.53 | B | A | A | A |
| Example 9 | 1.52 | B | A | A | A |
| Example 10 | 1.75 | A | A | A | A |
| Example 11 | 1.80 | A | A | A | B |
| Example 12 | 1.83 | A | A | A | B |
| Example 13 | 1.89 | A | A | A | B |
| Comparative Example 1 | 1.44 | C | A | A | C |
| Comparative Example 2 | 1.45 | C | A | A | C |
| Comparative Example 3 | 1.45 | C | A | A | C |
| Comparative Example 4 | 1.43 | C | A | A | C |

TABLE 5

| | Properties of ink jet recording sheets: Printing density | Absorptivity | Falling of powder | Water resistance | Coating irregularities |
|---|---|---|---|---|---|
| Example 14 | 1.68 | B | A | A | A |
| Example 15 | 1.64 | B | A | A | A |
| Example 16 | 1.80 | A | A | B | B |
| Example 17 | 1.64 | B | B | B | A |
| Example 18 | 1.65 | B | B | B | A |
| Comparative Example 6 | 1.45 | C | A | B | C |

TABLE 5-continued

| | Properties of ink jet recording sheets | | | | |
|---|---|---|---|---|---|
| | Printing density | Absorptivity | Falling of powder | Water resistance | Coating irregularities |
| Comparative Example 7 | 1.42 | C | B | B | B |
| Comparative Example 8 | 1.42 | C | B | B | B |
| Example 19 | 1.55 | B | C | C | A |
| Comparative Example 9 | 1.45 | C | C | C | C |

From the graph of the accumulated pore volume of the ink receiving layer shown in FIG. 1, it is evident that in the ink jet recording sheets of Example 1 (pore volume: 0.95 ml/g, pore volume of pores with pore radii of from 5,000 to 50,000 Å: 0.44 ml/g) and Example 12 (pore volume: 1.02 ml/g, pore volume of pores with pore radii of from 5,000 to 50,000 Å: 0.54 ml/g), the pore volume of the ink receiving layer is at least 0.80 ml/g, and the pore volume of pores having pore radii of from 5,000 to 50,000 Å in the ink receiving layer is at least 0.40 ml/g. On the other hand, the ink jet recording sheet of Comparative Example 1 (pore volume: 0.77 ml/g, pore volume of pores with pore radii of from 5,000 to 50,000 Å: 0.38 ml/g) does not satisfy such conditions. From Table 4, it is evident that the ink jet recording sheets of Examples 1 and 12 are distinctly superior in the printing density and the ink absorptivity to the ink jet recording sheet of Comparative Example 1.

Further, from the comparison of the results of Examples 1 to 13 and Comparative Examples 1 to 4 in Table 4, it is evident that the ink jet recording sheet containing amorphous silica having a pore volume of from 0.80 to 2.00 ml/g in a solid state as dried after formulated into a dispersed slurry at pH 11, according to the present invention, is excellent in the printing density and the ink absorptivity. Further, from the post-treating conditions of amorphous silica (Table 1) used in Examples 1 to 13 and Comparative Examples 1 to 4, it is evident that the pore volume of amorphous silica can be adjusted by storing amorphous silica under a natural environment condition, a heating condition, a humidifying condition or a heating and humidifying condition, and it is thereby possible to obtain an ink jet recording sheet having a good image quality.

Further, from all Examples and Comparative Examples, it is evident that when a mixed system of water/amorphous silica or water/alkali/amorphous silica is formulated into a dispersed slurry having a concentration of from 16 to 20% and a pH of 6.0 to 11.6 so that the viscosity of the dispersed slurry is from 40 to 300 cps, there is no coating irregularities (or printing irregularities) due to an increase in the viscosity of the coating liquid, and the image quality is good. However, as in Example 13, if the pore volume is too large i.e. in excess of 2.00 ml/g, the viscosity of the coating liquid decreases, and the fluidity becomes large, and slight coating irregularities are observed.

Further, in Example 19 or Comparative Examples 9, no alkali is added, whereby falling of powder is observed and water resistance of the ink receiving layer is inferior, and it is evident that by an addition of an alkali, the bonding of the amorphous silica becomes firm, whereby falling of the powder can be prevented, and the water resistance can be improved.

What is claimed is:

1. An ink jet recording sheet having an ink receiving layer formed on at least one side of a support, wherein the ink receiving layer contains amorphous silica treated by at least one method selected from 1) a method of leaving it in an environment at a temperature of from 50 to 70° C. for at least 3 days, 2) a method of leaving it in an environment with a humidity of from 60 to 80% for at least 3 days, and 3) a method of leaving it in an environment at a temperature of from 50 to 70° C. and with a humidity of from 60 to 80% for at least two days, and the pore volume in the ink receiving layer is at least 0.80 ml/g, and the pore volume of pores with pore radii of from 5,000 to 50,000 Å in the ink receiving layer is at least 0.40 ml/g.

2. The ink jet recording sheet according to claim 1, wherein the ink jet recording sheet further contains a cationic dye fixing agent in an amount to provide a cation charge of from 0.1 to 50 meq/$m^2$.

3. The ink jet recording sheet according to claim 1, wherein the amorphous silica has a secondary average particle size of from 2.0 to 8.0 $\mu$m.

4. The ink jet recording sheet according to claim 1, wherein the amorphous silica has a BET specific surface area of from 250 to 400 $m^2$/g.

5. The ink jet recording sheet according to claim 1, wherein the amorphous silica has an oil absorption of from 270 to 310 cc/100 g.

6. The ink jet recording sheet according to claim 1, wherein the amorphous silica has a bulk specific gravity of from 100 to 250 g/l.

7. The ink jet recording sheet according to claim 1, wherein the amorphous silica is such that when it is formulated into a dispersed slurry having a concentration of from 16 to 20% and a pH of from 6.0 to 11.6 in a mixed system of water/amorphous silica or water/alkali/amorphous silica, the viscosity of the dispersed slurry is from 40 to 300 cps.

8. The ink jet recording sheet according to claim 1, wherein the ink receiving layer contains at least one of alkali metal hydroxides.

9. An ink jet recording sheet having an ink receiving layer formed on at least one side of a support, wherein the ink receiving layer contains amorphous silica treated by at least one method selected from 1) a method of leaving it in an environment at a temperature of from 50 to 70° C. for at least 3 days, and 2) a method of leaving it in an environment at a temperature of from 50 to 70° C. and with a humidity of from 60 to 80% for at least two days, and the pore volume in the ink receiving layer is at least 0.80 ml/g, and the pore volume of pores with pore radii of from 5,000 to 50,000 Å in the ink receiving layer is at least 0.40 ml/g.

10. A process for producing an ink jet recording sheet, which comprises treating amorphous silica having a secondary average particle size of from 2.0 to 8.0 $\mu$m, a BET specific surface area of 250 to 400 $m^2$/g, an oil absorption of from 270 to 310 cc/100 g and a bulk specific gravity of from 100 to 250 g/l, by at least one method selected from 1) a method of leaving it in an environment at a temperature of from 50 to 70° C. for at least 3 days, 2) a method of leaving it in an environment with a humidity of from 60 to 80% for at least 3 days, and 3) a method of leaving it in an environment at a temperature of from 50 to 70° C. and with a humidity of from 60 to 80% for at least two days, then formulating it into a dispersed slurry, and coating the slurry on a support to form an ink receiving layer, wherein the pore volume in the ink receiving layer is at least 0.80 ml/g, and the pore volume of pores with pore radii of from 5,000 to 50,000 Å in the ink receiving layer is at least 0.40 ml/g.

* * * * *

UNITED STATES PATENT AND TRADEMARK OFFICE

CERTIFICATE OF CORRECTION

PATENT NO. : 6,383,611 B1
DATED : May 7, 2002
INVENTOR(S) : Kohno et al.

It is certified that error appears in the above-identified patent and that said Letters Patent is hereby corrected as shown below:

Title page,
Item [75], should read as follows:
-- [75] Inventors: Akira Kohno; Osamu Kojima; Takashi Kikuchi; Ikumi Sudoh, all of Tokyo (JP) --

Signed and Sealed this

First Day of October, 2002

*Attest:*

*Attesting Officer*

JAMES E. ROGAN
*Director of the United States Patent and Trademark Office*